United States Patent [19]

Hoffmann et al.

[11] 3,996,046

[45] Dec. 7, 1976

[54] EXTRACTION AND PURIFICATION OF SILVER FROM SULFATES

[75] Inventors: James E. Hoffmann, Berkeley Heights; Peter D. Parker, Edison; Andrew C. Sabo, Perth Amboy, all of N.J.

[73] Assignee: Amax Inc., New York, N.Y.

[22] Filed: July 25, 1975

[21] Appl. No.: 599,868

[52] U.S. Cl. ..... 75/99; 75/108; 75/118 R; 204/109; 423/35; 423/43

[51] Int. Cl.[2] ..... C22B 7/00; C22B 11/04; C25C 1/20

[58] Field of Search ..... 423/22, 27, 34, 35, 423/36, 45; 75/99, 100, 108, 101 R, 115, 118, 121, 508, 397; 204/109

[56] References Cited

UNITED STATES PATENTS

| | | | |
|---|---|---|---|
| 1,182,320 | 5/1918 | Ryan | 423/36 |
| 1,305,787 | 6/1919 | Ferguson | 75/99 |
| 3,141,731 | 7/1964 | Dietz | 423/43 |

OTHER PUBLICATIONS

Harkins, W. D. "The Effect of Salts Upon the Solubility of Other Salts", J.A.C.S. vol. 33, No. 12, Dec. 1911 pp. 1811–1814.

*Primary Examiner*—Oscar R. Vertiz
*Assistant Examiner*—Brian E. Hearn
*Attorney, Agent, or Firm*—Kasper T. Serijan; Eugene J. Kalil

[57] ABSTRACT

A method is provided for extracting silver from a silver sulfate-bearing substance, such as oxide materials, metal or metal sulfate mixtures containing silver sulfate which comprises subjecting said substance to aqueous leaching to remove soluble salts therefrom and leave a residue, taking the residue containing silver sulfate and other insoluble materials, such as insoluble salts, and forming a slurry with an aqueous solution of a metal sulfate, such as calcium nitrate, the amount of calcium nitrate being at least sufficient to effect metathetical exchange with the silver sulfate and form a silver nitrate solution containing substantially the silver originally present in the silver-sulfate bearing substance, and separating the silver nitrate solution from the residue remaining, and then purifying said solution, the silver being thereafter recovered from the silver nitrate solution by hydrolytic precipitation, electrowinning or other suitable means.

27 Claims, 2 Drawing Figures

EXTRACTION AND PURIFICATION OF SILVER FROM SULFATES

Figure 1:
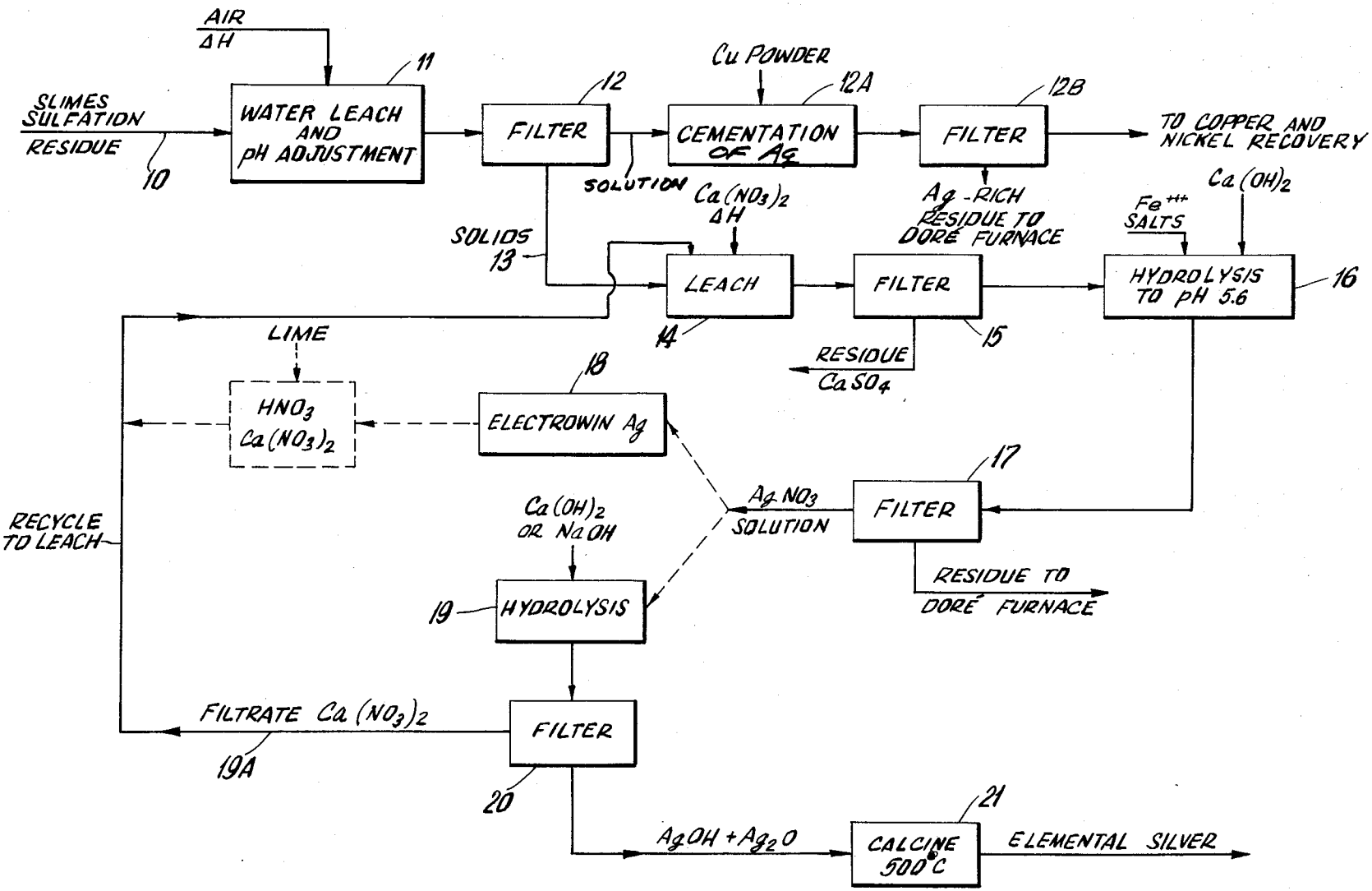

This invention relates to the recovery of silver from silver sulfate-bearing substances, such as oxide materials, metal or metal sulfate mixtures, and the like and, in particular, to the extraction of silver from sulfated anode copper slimes.

STATE OF THE ART

Anode slimes are produced during the electro-refining of anode copper produced from blister copper obtained in the pyrometallurgical treatment of copper sulfide matte. The slimes generally contain silver, and at least one of selenium, tellurium, antimony, arsenic bismuth, tin, copper, iron, nickel, lead, and the precious metals gold, platinum, palladium, rhodium, ruthenium, iridium, among other residuals.

One method is described in a paper presented at the 1972 Annual Conference of the Canadian Institute of Mining and Metallurgy, Aug. 27 to 30, at Halifax, Nova Scotia by R. K. Monahan and F. Loewen. In this method, anode slimes (95% through 250 mesh) are pumped to the silver refinery department as a slurry of 5% solids by weight where the solids are settled and filtered. A typical analysis on the dry basis comprises by weight 21% Cu, 22% Ni, 9.2% Se, 1 % Te and 1.5% Pb and, of course, the precious metals silver, gold, and the like.

The slimes filter cake is batch roasted with concentrated sulfuric acid in a gas-fired furnace at 700° to 800° F and the sulfated residue then leached with 10% sulfuric acid solution to dissolve out the nickel and copper sulfates, about half of the selenium in the slimes being volatilized and collected in a scrubber solution for further recovery. This cycle is repeated several times to reduce the combined copper and nickel to below 5%. The residue is then subjected to fire refining in a Dore furnace to produce a precious metal ingot from which the silver, gold and other precious metals are recovered.

Another method described in the aforementioned paper involves carrying out the sulfation at a temperature of about 420° F which is optimum for the satisfactory sulfation of copper and nickel at the highest practicable feed rates, and the undesirable sulfation and the subsequent solubilization of silver, which occurs at high temperature, is negligibly small. The feed to the reactor is a slurry of anode slimes in the form of a pulp containing about 30% aqueous solution and strong sulfuric acid.

At the operating sulfation temperature of 420° F, most of the water in the slurry is evaporated, the overall reaction being exothermic. The reacted slimes are subsequently leached with water to remove sulfated copper and nickel. The residue is then subjected to heating in a volatilization furnace to remove selenium as a gaseous product and the remaining residue then smelted in a Dore furnace to produce a precious metal alloy ingot from which the silver is recovered in silver parting cells, etc.

The disadvantage of smelting silver sulfate-bearing materials is the tendency of contamination with base metals which requires fluxing and slagging operations at relatively high temperatures to produce metal sufficiently pure and amenable to electrolytic silver refining. Additionally, it would be desirable to recover silver without using the conventional pyrometallurgical techniques now being employed with their attendant high energy consumption and generation of both $SO_2$ and $SO_3$ gases for which strict pollution abatement provisions must be made.

We have now discovered a simple hydrometallurgical process wherein silver can be selectively leached from substances containing silver sulfate, such as oxide materials, metal or metal sulfate mixtures or residues from which a purified silver solution may be obtained and from which solution silver may then be recovered by employing simple chemical processes.

OBJECTS OF THE INVENTION

It is thus an object of the invention to provide a process for recovering silver from silver sulfate-bearing substances.

Another object of the invention is to provide a hydrometallurgical process for the recovery of silver from anode slimes, such as copper or nickel anode slimes.

Figure 2:
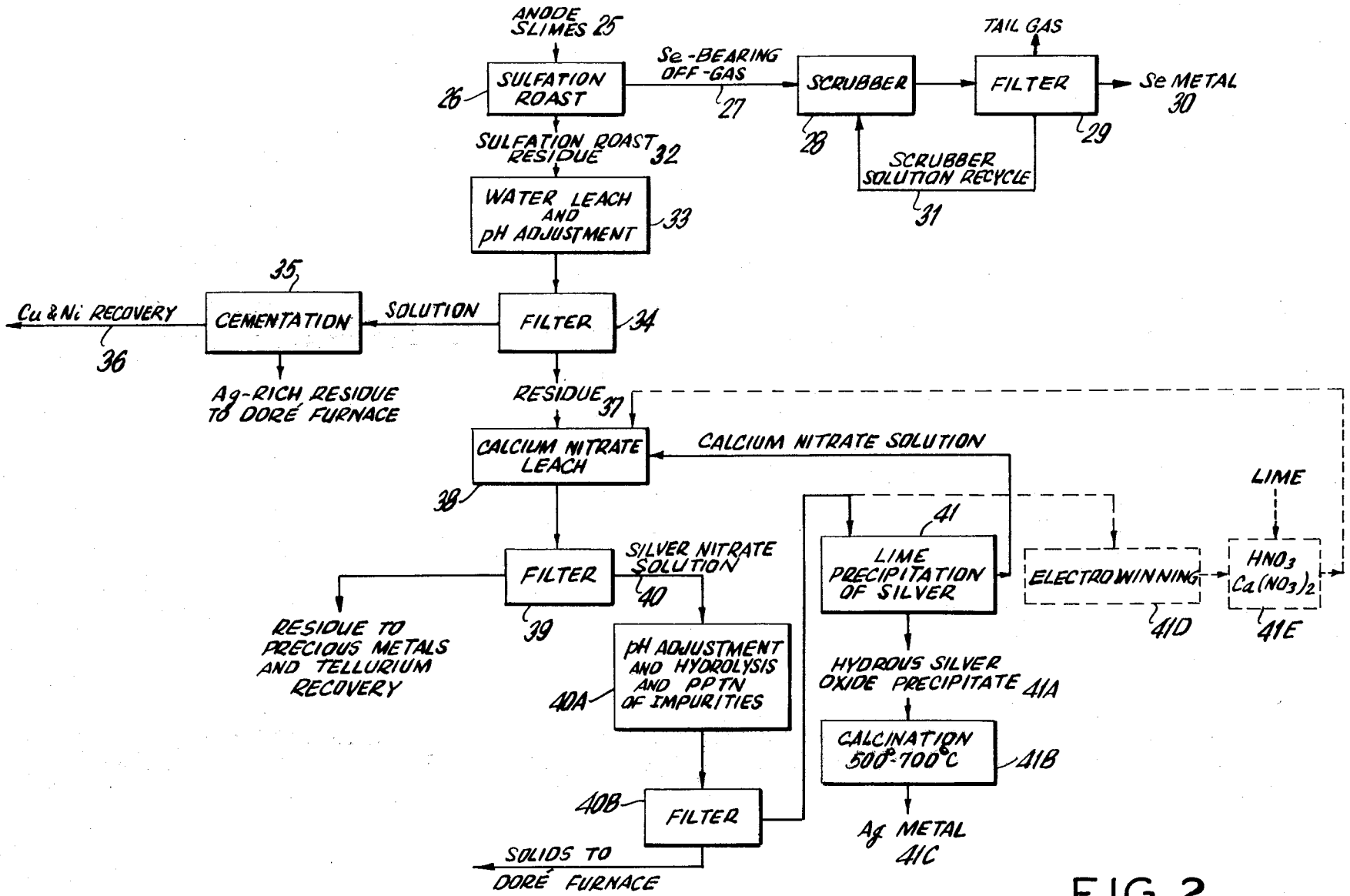

These and other objects will more clearly appear when taken in conjunction with the accompanying drawing wherein FIGS. 1 and 2 are flow sheets of preferred embodiments of the invention.

STATEMENT OF THE INVENTION

In its broad aspect, the invention resides in the selective leaching of silver from silver sulfate-bearing substances with a substantially neutral solution of calcium nitrate. The silver sulfate-containing substances may include oxide material, metal or metal sulfate mixtures. The reaction is metathetical between silver sulfate and calcium nitrate which occurs as follows:

$$Ag_2SO_4 + Ca(NO_3)_2 \rightarrow 2AgNO_3 + CaSO_4$$

The calcium ions are essential in moving the reaction to the right with the formation of the insoluble salt calcium sulfate.

While calcium nitrate is preferred, other soluble metal nitrate salts can be employed, depending upon the composition of the silver sulfate-bearing substance. Thus, the metal nitrate salt chosen as the solubilizing agent for the silver tied up as silver sulfate should be one which is substantially selective to metathetical exchange with said silver sulfate and not with other insoluble metal sulfates present. Such metal nitrate salts which may be employed include barium, strontium and lead nitrate.

It is important that the sulfates concentration during leaching be limited to a value below that at which the solubility limit of $Ag_2SO_4$ occurs. Should it exceed that value, silver would be precipitated from solution as silver sulfate and leaching of the silver would cease. In the event lead is present, the presence of the calcium ion achieves this requirement through the formation of lead sulfate. Also, if lead is present, it is important that sufficient sulfate be present to inhibit the formation of the very soluble $Pb(NO_3)_2$. The equilibrium solubility of $CaSO_4$ is sufficient to do this.

Nitrate ions are essential in order to form the highly soluble compound silver nitrate. The advantages of the nitrate ion are (a) the compound resists hydrolysis at relatively high pH's which allows for the hydrolytic removal of impurities; (b) silver can be conventionally recovered from the nitrate bath by electrolysis; and (c) the nitrate ion, because it is a mild oxidant, assists in hydrolysis.

Thus, the crux of the invention resides in the use of $Ca(NO_3)_2$ [or $Ba(NO_3)_2$, or $Sr(NO_3)_2$ in the absence of lead] as a solvent solution to dissolve silver sulfate by: (a) rejecting the sulfate ion to levels which will not inhibit silver solubility; (b) simultaneously generating a level of sulfate ion which inhibits lead solubility; and (c) introducing an ion ($NO_3^-$) which forms a highly soluble silver compound capable of remaining in solution at pH's at which many impurities will be rejected by hydrolysis.

Broadly speaking, the silver-containing metal sulfate mixture which generally contains water soluble and insoluble metal sulfates, is subjected to aqueous leaching to remove said water soluble sulfates, e.g. copper and/or nickel sulfates, following which the silver sulfate-containing residue is slurried with a solution of calcium nitrate, the calcium nitrate being at least sufficient to react stoichiometrically with the silver sulfate according to the reaction set forth hereinabove. It should be understood that the addition of considerable excess of calcium nitrate does not, however, restrict the efficiency of the process. An excess of 50 or 100% or greater may be used.

The silver nitrate solution formed is then separated from the remaining residue, as for instance by filtration, the silver being thereafter recovered from the silver nitrate solution. One method of recovery is to first raise the pH of the silver nitrate solution to a level not exceeding that value at which basic silver hydrous oxide hydrolyzes out as a precipitate, the pH being sufficient to effect the hydrolytic precipitation of impurities in said silver nitrate solution. Thus, the pH within the foregoing context may range up to about 6 and preferably from about 5 to 6. The precipitated impurities are removed from solution by filtration and the purified solution then treated with sufficient calcium hydroxide, or alkali or other alkaline earth metal hydroxide to precipitate out the silver as the hydrous oxide by raising the pH to at least about 8. Calcium hydroxide is preferred as it results in the regeneration of calcium nitrate for recycling back with the process. Generally, a pH of between 8 to 9 suffices. Metallic silver may be recovered from the silver hydrous oxide precipitate merely by high temperature calcination, e.g. by heating to over 300° C but less than the melting point of silver, or from about 500° to 800° C, to decompose said precipitate to elemental silver.

Alternatively, the silver can be recovered by electrolysis from the purified silver nitrate solution.

The foregoing process is particularly applicable to the extraction of silver from copper or nickel anode slimes. In preparing the foregoing slimes for treatment in accordance with the invention, the slimes are subjected to a sulfating roast to convert the contained metals to metal sulfates, while substantially elminating the selenium therefrom by oxidation and vaporization as described, for instance, in Finnish Pat. No. 46,054.

The metal sulfate mixture obtained from the sulfating roast may be treated according to the flow sheet of FIG. 1 of the accompanying drawing. As will be noted, the sulfated slimes 10 are subjected to a water leach at 11 with subsequent pH adjustment to a range of about 3 to 4 for rejection of iron at a temperature range of about room temperature to 100° C to solubilize the copper and nickel present and the solution filtered off at 12 and sent to cementation at 12A where silver present as slightly soluble silver sulfate is removed as metal. The solution from 12A is filtered off at 12B and sent to copper and nickel recovery, while the silver-rich residue remaining is sent to the Dore furnace for recovery of silver in the conventional manner. The solids 13 containing the insoluble metal sulfates are slurried with a calcium nitrate solution at 14 to leach out the silver as silver nitrate, with the calcium ion combining with the sulfate to form the insoluble calcium sulfate, the temperature of the slurry being preferably about 75° to 110° C or 90° to 110° C. Broadly, the temperature may go down to room temperature. The reacted slurry is then filtered at 15 to separate the calcium sulfate containing residue from the silver nitrate solution.

The pH of the silver nitrate solution is then raised at 16 by adding $Ca(OH)_2$ to about 5 to 6, ferric ions being preferably added to provide a ferric hydroxide precipitate to collect one or more of the elements Sb, As, Te, Se, etc., rejected by hydrolysis as a hydrous oxide from the solution at the foregoing pH. The amount of iron added will depend on the level of impurities in the solution, the amount being effective to hydrolyze as ferric hydroxide and assist in the collection of the hydrolyzed impurities. The amount of ferric ion may be at least 0.1 grams/liter. The equivalent of about 1 to 5 grams/liter of $Fe^{+++}$ will suffice.

The foregoing silver nitrate solution is filtered at 17. The disposal of the final residue following filtering at 17 is dependent on the metal values present. The residue may be treated hydrometallurgically, or pyrometallurgically, or the residue may be rejected entirely.

The silver nitrate solution is either sent to electrowinning at 18 or treated with an alkaline reagent at 19, e.g. $Ca(OH)_2$ or NaOH, to precipitate a hydrous precipitate of silver oxide. It is preferred to use $Ca(OH)_2$ in order to regenerate calcium nitrate 19A for recycle to the silver leach step at 14. The hydrous oxide precipitate is filtered at 20 and the hydrous oxide calcined at 21 at about 500° C, thereby decomposing the precipitate and forming high purity elemental silver.

The electrowinning of silver possesses the advantage of directly producing elemental silver of potentially greater purity (99.9%). However, it would probably require a silver recycle stream. Precipitation by hydrolysis with either NaOH or $Ca(OH)_2$ can remove silver to extremely low levels (less than 0.001 grams/liter).

An embodiment of an overall process utilizing the novel process of the invention for extracting silver from anode slimes is depicted in FIG. 2.

Anode slimes 25 are subjected to sulfation roast at 26 wherein the slimes are mixed with 66° Be sulfuric acid solution to convert the metal ions present into sulfates, and oxidize and volatilize the selenium present in the slimes, the duration and temperature of the sulfation roast being in part determined by the composition of the slimes, especially as regards the selenium content which is well known to those skilled in the art. The selenium-bearing off-gas 27 produced is passed through a scrubber 28, the solution containing the now elemental selenium being passed through filter 29, with the tail gas going up the stack and the selenium being recovered as selenium metal 30. Scrubber solution recycle 31 is provided for as shown.

The sulfation roast residue is subjected to a water leach with subsequent pH adjustment to a range of about 3 to 4 at 33, the solution being separated from the residue at 34, the solution then going to cementation at 35 where silver present as the slightly soluble silver sulfate is reduced to metal and precipitated with copper as follows:

$$Ag_2SO_4 + Cu \rightarrow CuSO_4 + 2Ag.$$

The amount of silver recovered represents about 3% to 4% of the total by weight. The copper and nickel sulfate solution remaining is stripped of its copper content at 36, preferably by electrowinning, the decopperized solution thence passing to evaporators for the recovery of nickel sulfate and sulfuric acid. The residue from silver cementation goes to the Dore furnace for the recovery of silver therefrom in the conventional manner.

The silver sulfate-containing residue 37 following filtering at 34 is slurried with a calcium nitrate leach solution at 38 containing sufficient $Ca(NO_3)_2$ at least stoichiometrically equivalent to effect metathetical exchange with the silver sulfate in the residue. The reacted slurry is filtered at 39 to provide a silver nitrate solution 40. Silver nitrate solution 40 is then sent to pH adjustment at 40A for hydrolytic purification, filtered at 40B, the separated solids at 40B eventually going to the Dore furnace, with the purified silver nitrate solution going to lime precipitation at 41.

The residue obtained at filter 39 and which contains precious metals, and other residual elements, is set aside for the subsequent treatment thereof.

The treatment of the silver nitrate solution at 41 with lime $[Ca(OH)_2]$ effects the precipitation of silver hydrous oxide 41A at a pH of about 8 to 9 or 10. The precipitate is filtered, with the regenerated calcium nitrate solution recycled to calcium nitrate leach at 38 and the precipitate going to calcination treatment step 41B where the precipitate is calcined at a temperature of about 500° C to 800° C and decomposed to elemental silver metal 41C assaying about 99.7% silver. Optionally, the purified silver nitrate solution at 41 may be stripped of its silver content by electrowinning at 41D, the acid generated thereby ($HNO_3$) being neutralized with $Ca(OH)_2$ at 41E and thus, in effect, regenerate calcium nitrate solution for recycling to 38.

As illustrative of the invention, the following example is given.

About 400 grams of copper anode slimes were sulfation roasted as described hereinbefore wherein the selenium was eliminated by oxidation with sulfuric acid and subsequent volatilization of the oxide.

The substantially selenium-free sulfation roast residue was then water leached to remove copper and nickel sulfate and the residue thereof slurried with one liter of solution containing 336 grams/liter of $Ca(NO_3)_2$ at a temperature of about 95° to 105° C, the residue being leached for about 30 minutes with moderate agitation.

The pH of the lixiviant [$Ca(NO_3)_2$ solution] decreased from an initial value of 5.6 to approximately 1 in the final leach slurry. The leach slurry was filtered hot and the filter cake flood washed twice with 100 ml portions of water. The filter cake (leached residue) was dried and analyzed for silver.

The pregnant silver nitrate-calcium nitrate solution generated by leaching was treated to remove impurities by raising the pH to about 5.6 by adding calcium hydroxide $[Ca(OH)_2]$, at which pH substantially all of the silver remains in the solution. The impurities, such as Te, As, Sb, Bi, Sn, Fe, Cu, etc., report in a mixed precipitate of hydrous oxides and basic nitrates. As stated earlier, the presence of iron in the nitrate leach liquor has a salutory effect upon the purification through the formation and occlusion of ferric arsenites, selenites, tellurites and other impurities.

As stated herein, it is preferred that the solution at the time of precipitation contain an effective amount of ferric ion to assist in the collection of the hydrolyzed impurities, such as 0.1 gram/liter and above, depending upon the level of impurities.

The hydrolytic precipitates were filtered off and the purified silver nitrate solution was treated with sufficient additional calcium hydroxide to raise the pH to at least about 8.3 so as to precipitate the silver substantially quantitatively as a brown silver hydrous oxide.

The precipitate was filtered off and washed free of calcium nitrate. The calcium nitrate solution was recycled back to the leaching circuit. The silver-bearing precipitate was then dried and thermally decomposed to elemental silver metal and melted under silica sand to remove any residual unreacted lime which may have occluded with the silver-bearing precipitate. The silver distributions and the assays for the various steps and products herein described are given below.

| | Silver Distribution | | | |
|---|---|---|---|---|
| | wt/vol. | Assay/conc. | Ag content | % of total |
| Water Leach Residue to Leaching | 400 g | 26.7% | 106.8 g | 100% |
| Solubilized in $Ca(NO_3)_2$ Leach | 1.0 liter | 93.0 g/l | 93.0 g | 89.2% |
| Lost to Hydrolysis Residue | 16.2 g | 14.6% | 2.4 g | 2.2% |
| Overall Recovery as High Purity Silver | 93.2 g | 99.7% | 93.0 g | 87.0% |

The silver button was sampled by drilling and analyzed to provide the following composition:

| Element | % Analysis |
|---|---|
| Ag | 99.7 |
| Cu | 0.005 |
| Te | 0.003 |
| Se | 0.01 |
| Pt | <0.001 |
| Pd | <0.002 |

The silver in the button represented a recovery of about 87.0% referred to the silver content of the water leach residue.

As an alternative, the silver nitrate solution may be precipitated by using other bases, such as NaOH. However, these other bases would add foreign ions into the system which would interfere with the recycle of $Ca(NO_3)_2$ solution as a preferred embodiment.

On the other hand, the silver in the purified nitrate solution may be recovered by electrowinning from said solution.

While the crux of the invention resides in the use of a calcium nitrate solution in the selective leaching of silver sulfate-bearing substances, such as metal and metal sulfate mixtures, the invention is particularly applicable to an overall unit operation for treating copper or nickel anode slimes.

Thus, in summary, a process is provided for extracting silver from anode slimes, the process comprising subjecting the slimes to sulfation roast at an elevated temperature whereby selenium, if present, is substantially completely removed as a selenium-bearing off-gas for subsequent recovery thereof; leaching the residue with an aqueous solution (e.g. water or dilute acid) to dissolve soluble metal sulfates present and other soluble metal sulfates present; filtering the leached residue; and forming an aqueous slurry of said residue with a solution of calcium nitrate containing an amount of calcium nitrate at least sufficient stoichiometrically to effect metathetical exchange between said calcium nitrate and said silver sulfate, thereby producing a silver nitrate solution containing substantially said silver, e.g. about 90% to 95%, originally present in the water leach residue.

The silver nitrate solution is separated from said residue, with the residue set aside for further treatment. The pH of the silver nitrate solution is then adjusted to a range selective to precipitation of hydrous oxides of impurities, such as Fe, Te, Cu, As, Sb, Se, Bi, Sn, etc., for example, a pH ranging up to about 6, e.g. 5 to 6. Following this treatment, the precipitate is separated from said silver nitrate solution.

The pH of the silver nitrate solution is then adjusted with a base [preferably $Ca(OH)_2$] to at least 8, e.g. 8 to 9, to precipitate silver hydrous oxide precipitate, the precipitate separated from the solution and thereafter calcined at an elevated temperature (e.g. 500° to 700° C or 800° C) to decompose the oxide to elemental silver of at least about 99% purity, the calcium nitrate solution regenerated being accumulated for recycling as leach solution to the water leach residue.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A process of extracting silver from a silver sulfate-bearing substance which comprises, forming a slurry of said substance in a solution of a metal nitrate solubilizing agent selected from the group consisting of calcium nitrate, barium nitrate, strontium nitrate and lead nitrate, selective to metathetical exchange with silver sulfate and not with other metal sulfates present, the amount of metal nitrate being at least sufficient stoichiometrically to effect said metathetical exchange with said silver sulfate, thereby forming a solution containing substantially the silver originally present in said residue, and then separating said silver nitrate solution from said residue.

2. The process of claim 1, wherein said metal nitrate is calcium nitrate.

3. The process of claim 2, wherein the silver nitrate solution formed is adjusted to a pH not exceeding that amount at which basic silver hydrous oxide precipitates but sufficient to precipitate impurities therein by hydrolysis, and then separating the silver nitrate solution from said precipitate.

4. The process of claim 3, wherein said pH is adjusted up to about 6.

5. The process of claim 3, wherein said pH ranges from about 5 to 6.

6. The process of claim 3, wherein said solution prior to hydrolysis contains an amount of ferric ion therein which precipitates by hydrolysis as ferric hydroxide and assists in the collection of the hydrolyzed impurities.

7. The process of claim 3, wherein the separated silver nitrate solution is further adjusted to a pH of at least about 8 to precipitate silver as silver hydrous oxide, and wherein said precipitated silver hydrous oxide is separated from solution and decomposed to silver metal by calcining said oxide at an elevated temperature over 300° C and less than the melting point of silver.

8. The process of claim 3, wherein the silver in the separated silver nitrate solution is recovered by electrolysis.

9. The process of claim 1, wherein the silver sulfate-bearing substance treated is anode slimes.

10. A process of extracting silver from anode slimes containing silver and at least one of the elements selected from the group consisting of Cu, Ni, Fe, Te, Pb, Se, As, Bi, Sn, Sb and precious metals, wherein said slimes are subjected to a sulfating roast and the sulfated slimes leached to form an aqueous solution of soluble sulfates and leave a silver sulfatecontaining residue which comprises, forming an aqueous slurry of said residue with a solution of a metal nitrate solubilizing agent selected from the group consisting of calcium nitrate, barium nitrate, stontium nitrate and lead nitrate, selective to methatetical exchange with silver sulfate and not with other metal sulfates present, the amount of nitrate salt added being at least stoichiometrically sufficient to effect metathetical exchange with said silver sulfate and form a silver nitrate solution containing substantially the silver originally present in said residue, separating the residue remaining from said silver nitrate solution, adjusting said solution to a pH not exceeding that value at which basic silver hydrous oxide precipitates but sufficient to precipitate impurities therein by hydrolysis, and then separating said silver nitrate solution from said precipitate.

11. The process of claim 10, wherein the separated silver nitrate solution is adjusted to a pH of at least about 8 and thereby precipitating silver hydrous oxide, wherein the precipitated silver hydrous oxide is separated from the solution and decomposed to silver metal by calcining said oxide at a temperature of over 300° C and less than the melting point of silver.

12. The process of claim 11, wherein said oxide is decomposed at a temperature of about 500° to 800° C.

13. The process of claim 11, wherein the silver hydrous oxide precipitate is formed by adjusting said pH with $Ca(OH)_2$ and wherein the calcium nitrate formed thereby is recycled for treating said silver sulfate-containing residue for conversion into silver nitrate.

14. The process of claim 10, wherein the silver in said separated silver nitrate solution is recovered by electrolysis.

15. The process of claim 10, wherein said metal nitrate is calcium nitrate.

16. The process of claim 15, wherein the metathetical exchange between silver sulfate and calcium nitrate is carried out at a temperature ranging from about 15° to 110° C.

17. The process of claim 16, wherein the temperature ranges from about 75° to 110° C.

18. The process of claim 10, wherein the pH of the solution is adjusted up to about 6.

19. The process of claim 18, wherein said pH ranges from about 5 to 6.

20. The process of claim 18, wherein said solution prior to hydrolysis to precipitate the impurities therein contains an amount of ferric ion therein which precipitates by hydrolysis as ferric hydroxide and assists in the collection of the hydrolyzed impurities.

21. A process for extracting silver from anode slimes containing silver, selenium and at least one of the metals Fe, Cu, Ni, Te, Pb, As, Bi, Sb, Sn and precious metals which comprises, subjecting said slimes to a sulfation roast at an elevated temperature whereby selenium is removed as a selenium-bearing off-gas for subsequent recovery thereof and whereby a sulfation roast residue is formed, leaching said residue to provide an aqueous solution of soluble metal sulfates, separating said solution from the leached residue, forming an aqueous slurry of said residue with a solution of calcium nitrate, the amount of calcium nitrate being at least sufficient stoichiometrically to effect metathetical exchange between said calcium nitrate and said silver sulfate, whereby a solution of silver nitrate is formed containing substantially the silver in said residue, separating said silver nitrate solution from the remaining residue, adjusting the pH of said silver nitrate solution to an amount ranging up to about 6 sufficient to precipitate hydrous oxides of metal impurities therein, and separating said precipitate from said silver nitrate solution and provide a purified silver nitrate solution.

22. The process of claim 21, wherein the pH of the separated silver nitrate solution is adjusted to at least about 8 by adding $Ca(OH)_2$ to said solution to precipitate silver hydrous oxide which is separated from the calcium nitrate solution formed and wherein said silver hydrous oxide is decomposed to metallic silver by calcining said oxide at a temperature over 300° C and less than the melting point of silver.

23. The process of claim 22, wherein said silver oxide is decomposed at a temperature in the range of about 500° to 800° C.

24. The process of claim 22, wherein the solution of calcium nitrate formed is recycled for treating further silver-sulfate residue formed following sulfation of anode slimes and the aqueous leaching thereof.

25. The process of claim 21, wherein the metathetical exchange between the silver sulfate and the calcium nitrate is carried out at a temperature ranging from about 15° to 110° C.

26. The process of claim 25, wherein the temperature ranges from about 75° to 110° C.

27. The process of claim 21, wherein the silver in said separated silver nitrate solution is recovered by electrolysis.

* * * * *